US006748632B2

(12) United States Patent
Nakai

(10) Patent No.: US 6,748,632 B2
(45) Date of Patent: Jun. 15, 2004

(54) MATERIALS AND PRODUCTS USING STRIP OF REAL OR ARTIFICIAL FUR

(75) Inventor: Tsuyoshi Nakai, Hong Kong (HK)

(73) Assignee: Nabro Corporation Limited, Kowloon (HK)

( * ) Notice: Subject to any disclaimer, the term of this patent is extended or adjusted under 35 U.S.C. 154(b) by 191 days.

(21) Appl. No.: 10/018,782

(22) PCT Filed: Apr. 27, 2001

(86) PCT No.: PCT/JP01/03755

§ 371 (c)(1),
(2), (4) Date: Dec. 21, 2001

(87) PCT Pub. No.: WO01/82726

PCT Pub. Date: Nov. 8, 2001

(65) Prior Publication Data

US 2002/0160142 A1 Oct. 31, 2002

(30) Foreign Application Priority Data

Apr. 28, 2000 (JP) ..... 2000-130077

(51) Int. Cl.[7] ..... D04H 3/04
(52) U.S. Cl. ..... 28/100; 69/22
(58) Field of Search ..... 2/65, 244; 28/100, 28/299; 69/22; 57/4, 28; 428/85

(56) References Cited

U.S. PATENT DOCUMENTS

| | | | | |
|---|---|---|---|---|
| 2,112,036 A | | 3/1938 | Loscher | |
| 4,741,055 A | | 5/1988 | Lee | 2/65 |
| 5,167,113 A | * | 12/1992 | Yoshioka | 57/236 |
| 5,440,793 A | | 8/1995 | Yoshioka | 28/100 |
| 5,466,497 A | * | 11/1995 | Mosler | 428/15 |

FOREIGN PATENT DOCUMENTS

| | | | | |
|---|---|---|---|---|
| DE | 826 283 | | 11/1951 | |
| DE | 8625306 | | 1/1987 | A41D/5/00 |
| DE | 43 41 680 | | 6/1994 | D03D/15/00 |
| FR | 384 612 | | 4/1908 | |
| GB | 2 065 182 | * | 6/1981 | |
| JP | 57-74953 | | 10/1955 | |
| JP | 61-155384 | | 9/1986 | D03D/15/02 |
| JP | 64-045836 | | 2/1989 | D02G/3/10 |
| JP | 01-213432 | | 8/1989 | D03D/15/02 |
| JP | 05-171551 | | 7/1993 | D04D/7/02 |
| JP | 06-081000 | | 3/1994 | C14B/15/04 |
| JP | 3008585 | | 12/1994 | D03D/15/02 |
| JP | 3027596 | | 5/1996 | D04B/1/14 |

OTHER PUBLICATIONS

Steven Warner, Fiber Science, 1995, Prentice–Hall, Inc., pp. 130–132 and 136–139.*

English Language Abstracts of Jap.Pat.Pub. Nos. 64–045836, 01–213432, 05–171551 and 06–081000.

* cited by examiner

*Primary Examiner*—Gary L. Welch
(74) *Attorney, Agent, or Firm*—Michael D. Bednarek; Shaw Pittman LLP

(57) ABSTRACT

A fur material (1) includes an elastic net (2) and a fur strip (3) provided with real or artificial hair (3*a*). The net (2), made up of warps (4) and wefts (5), is stretchable in one or more directions. The fur strip (3) is wound around one of the wefts (5) that is reinforced by an auxiliary string (6). The net (2) is provided with an attachment area (2*a*) to be brought into engagement with buttons on clothes.

12 Claims, 9 Drawing Sheets

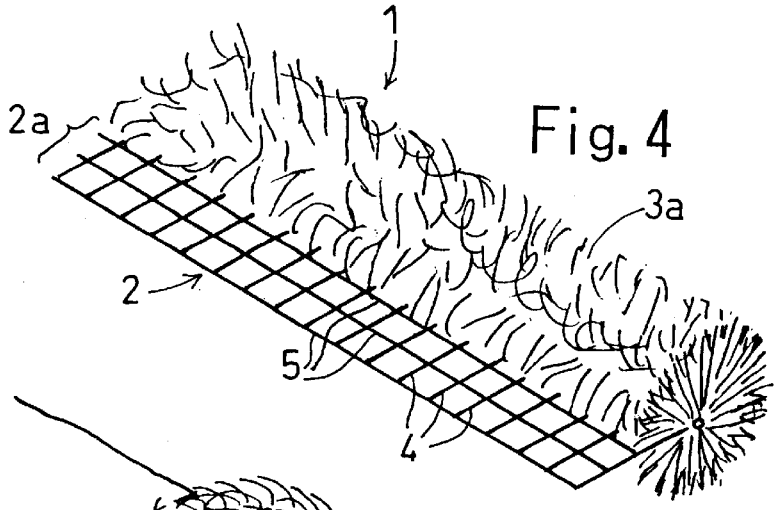
Fig. 4
Fig. 5
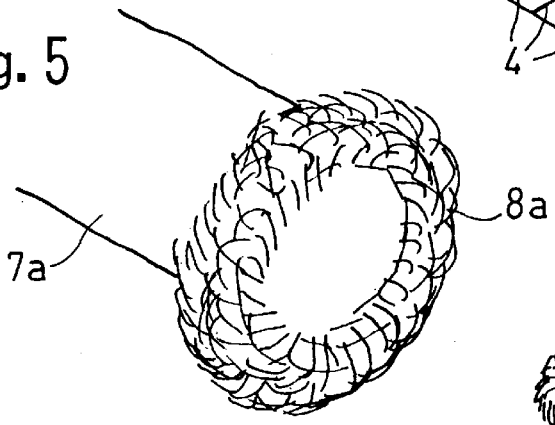
Fig. 6
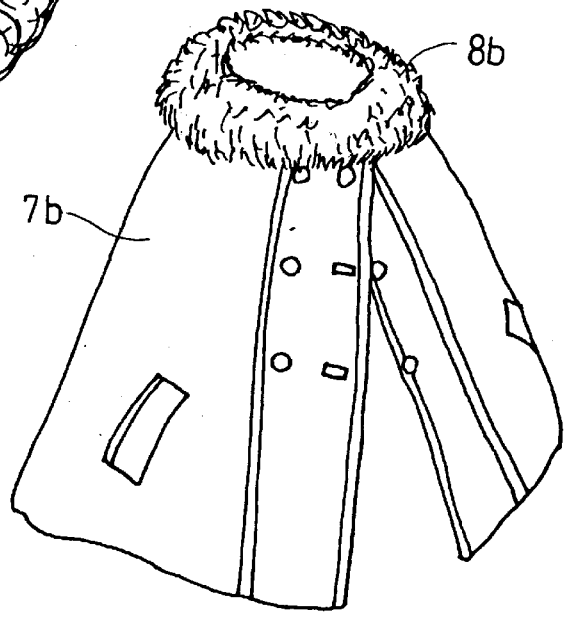
Fig. 7
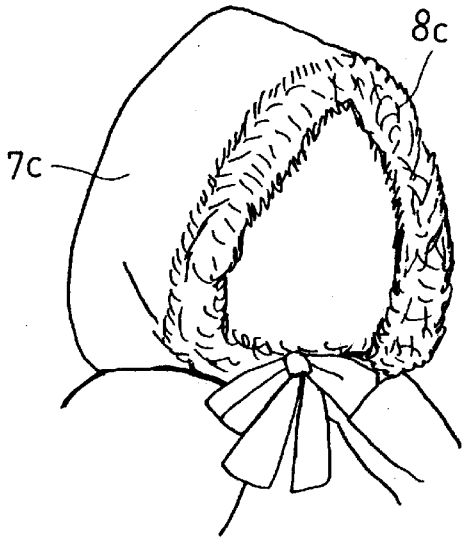

Fig. 20
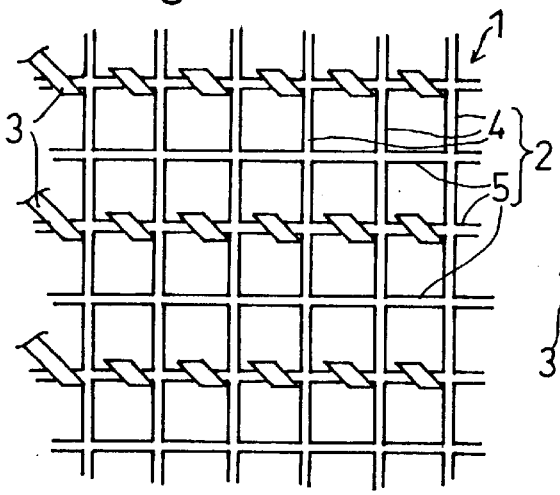
Fig. 21
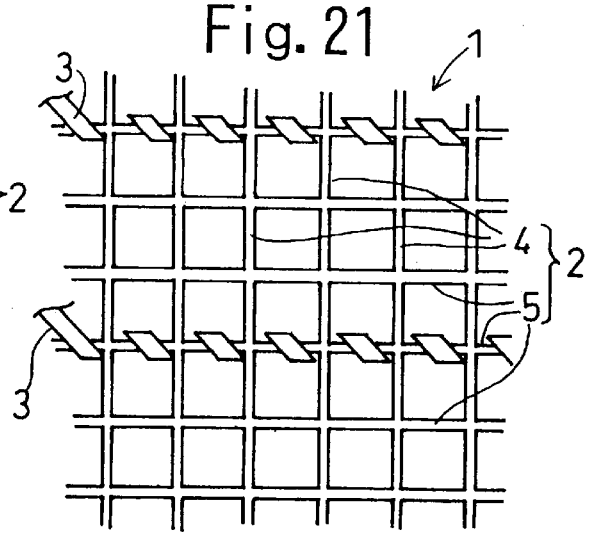
Fig. 22
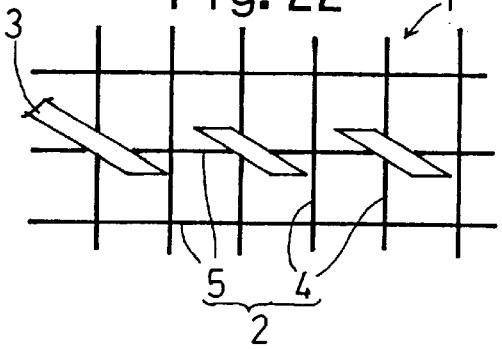
Fig. 23
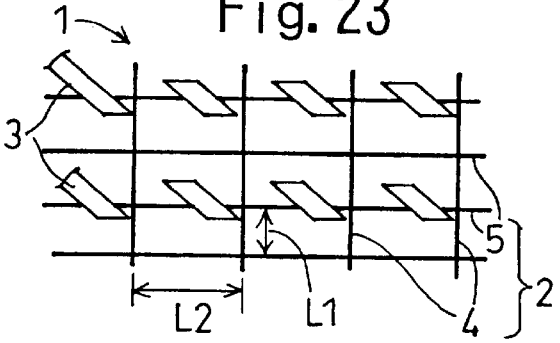
Fig. 24
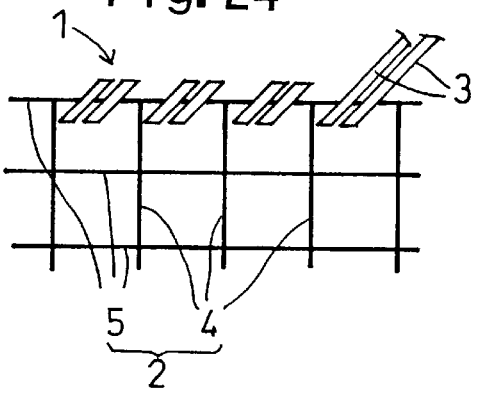
Fig. 25
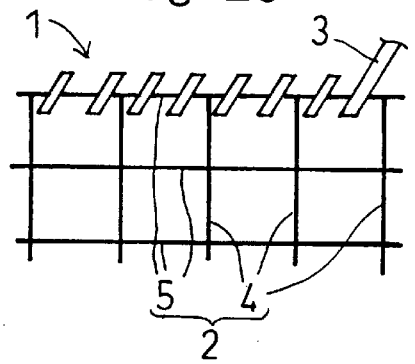
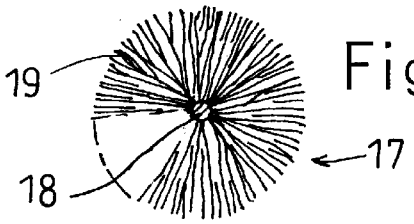
Fig. 26

Fig. 27
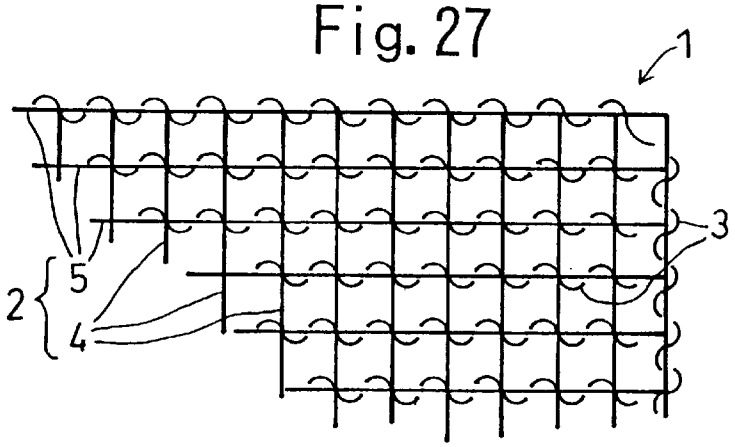
Fig. 28
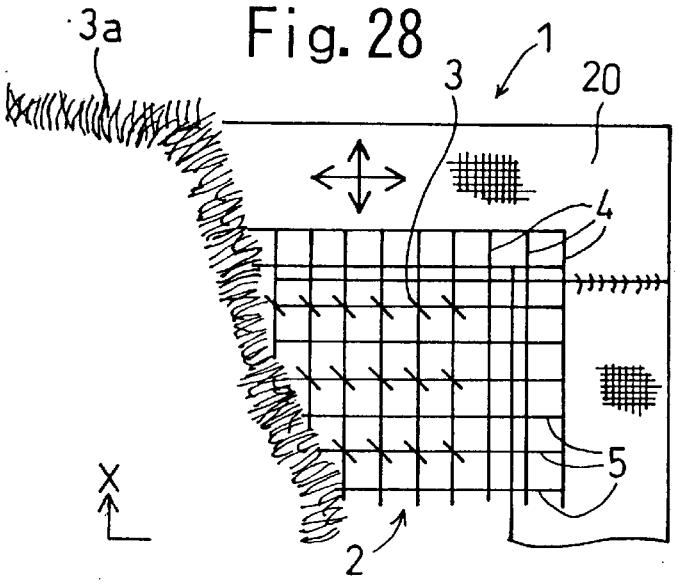
Fig. 29
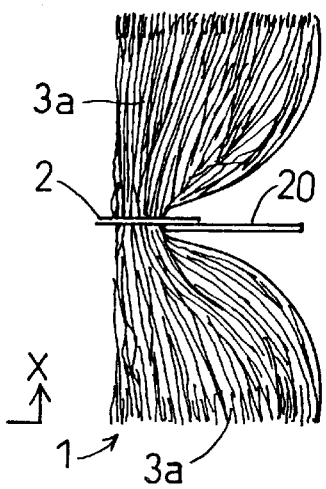
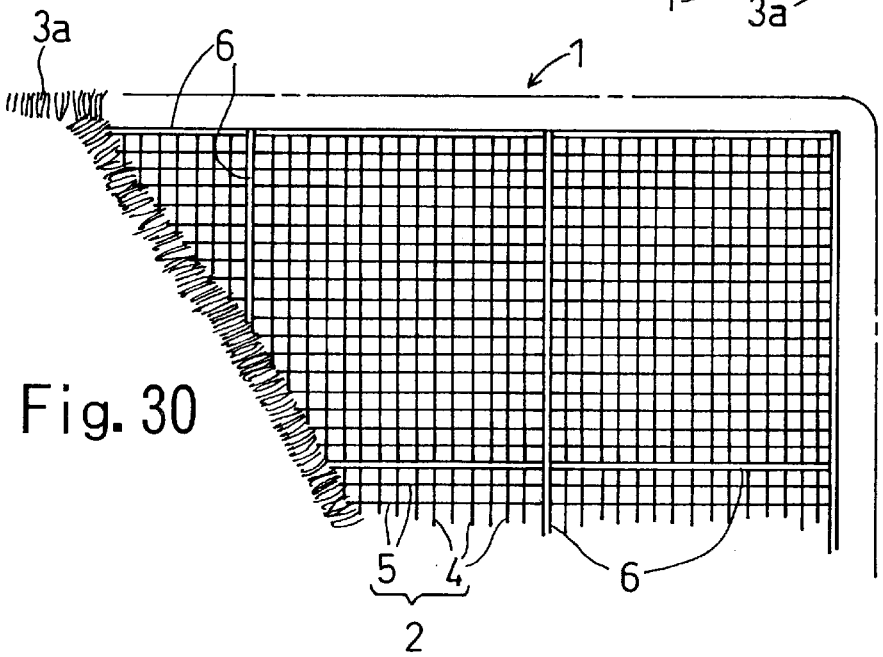
Fig. 30

MATERIALS AND PRODUCTS USING STRIP OF REAL OR ARTIFICIAL FUR

TECHNICAL FIELD

The present invention relates to materials using strips of real or artificial fur. It also relates to products using such materials.

BACKGROUND ART

Products using real or artificial fur materials come in various types and sizes. As is known, real fur can be obtained from several kinds of animals including foxes, rabbits, minks, etc. Among these, mink fur is very popular for fabricating garments for example.

Unfavorably, a single mink may be able to provide only a small amount of fur which is insufficient to make a desired garment. For example, an overcoat is a rather large garment, the fabrication of which may require many minks. In such an instance, pieces of fur material obtained from a certain number of minks may first be cut into a suitable shape, and then sewn together, to make the final product.

Unfavorably, the conventional mink coat tends to be rather heavy and look monotonous (hence too conservative) since many fur pieces of the same kind are used.

Further, the fabrication of the conventional coat requires every piece of fur material to be larger than a certain minimum standard. However, it is not always easy to prepare such fur material in sufficient quantities.

One conventional way to address the above problems is as follows. First, raw fur is cut into a number of strips. Then, the obtained fur strips are put together to provide a secondary raw material from which a final product is obtained.

Specifically, JP-U-61(1986)-155384, JP-A-64(1989)-45836 and JP-A-1(1989)-213432 teach that a strip of fur material is woven with another strip of fur or non-fur material to produce a secondary raw material. Likewise, JP-U-No. 3027596 teaches that a strip of fur material and a string of wool are knitted to provide a secondary raw material.

JP-A-5(1993)-171551, JP-A-6(1994)-81000 and JP-U-No.3008585 teach that a strip of fur material is intertwined with a net-like base.

JP-U-57(1982)-74953 teaches an alternate arrangement of fur strips and elastic cloth strips. These two kinds of strips are sewn together to provide a secondary raw material. Besides this, JP-U-57-74953 teaches a checkerboard arrangement of rectangular fur strips and rectangular elastic cloth. Again, these strips are sewn together to provide a secondary raw material.

The above-mentioned JP-A-5-171551 reference discloses that the net-like base is made of polyester thread, while JP-A-6-81000 discloses that the net-like base is made of mixed-spun thread of hemp and rayon. It should be noted here that both the polyester thread and the hemp-rayon thread are substantially non-elastic material.

The conventional secondary raw materials described above have been found disadvantageous in the following respects.

The above secondary raw materials, except the ones disclosed in JP-U-57-74953, are fundamentally of non-elastic nature. (Of course, they cannot be completely rigid, and are prone to slight distortion upon application of a stretching force). Thus, when the conventional materials are used for making clothing such as vests, sweaters, etc., the final products (i.e., vests, sweaters, etc.) should be considerably large for allowing the wearers to easily put on or take off them. However, these unduly large garments are uncomfortable to wear and may give an unattractive appearance. Consequently, the value of the garments as commercial commodities may be degraded.

On the other hand, when use is made of the materials disclosed in JP-U-57-74953, the resulting garments may fit the wearers very well However, the conventional technique requires the weaving of many fur materials and elastic cloth pieces, which may take a great deal of time and labor, thereby reducing the productivity. In addition, the woven parts of the garments are relatively weak and therefore liable to split when an external force is exerted. The problems of lowered productivity and reduced strength may be aggravated when the fur strips and the elastic cloth pieces are made smaller in width. (For aesthetic purposes, the widths of each fur strip and each cloth piece are preferably as small as possible, so that the elastic cloth and the skin of the fur strip are entirely hidden in the hair of the fur.

Another problem may occur in using the conventional fur strips. When a winter coat (or other heavy winter clothes as well) is made of non-fur material such as wool, a fur accessory may often be attached to e.g. the collar, the cuffs, the hood, or the hem of the coat. Preferably, the accessory is removable, so that the wearer can replace one accessory with another depending upon the weather or any other condition. Specific means for achieving such a replaceable arrangement may be a combination of buttons attached to the coat and cooperative button holes formed in the fur accessory. Disadvantageously, when the fur accessory is made of a conventional non-elastic fur material, the removal or attachment easiness of the accessory will conflict with the stability of the accessory. Specifically, when the button holes of the accessory are made large enough for facilitating the attachment or removal of the accessory, the accessory may accidentally come off the buttons rather readily. On the other hand, when the button holes of the accessory are made small enough to reliably prevent the accidental come-off of the accessory, the wearer may find it difficult to pass the buttons on the coat through the button holes of the accessory.

DISCLOSURE OF THE INVENTION

The present invention has been proposed under the circumstances described above. It is, therefore, an object of the present invention to provide a fur material which does not suffer from the above-described conventional problems. Another object of the present invention is to provide products using such an advantageous fur material. Examples of products may be • clothing such as sweaters, vests, jackets, overcoats or gowns • accessories for clothing, such as collar trims, cuff trims or hem trims • personal items for keeping warm or decoration, such as mufflers, shawls, leg warmers, wrist bands, arm warmers, belts, lap robes, hats or gloves • bedding such as blankets or Japanese futon • toys or entertaining items such as stuffed animals or animal costumes • containers such as bags or pouches, and accessories for such containers.

According to a first aspect of the present invention, there is provided a fur material comprising: an elastic base having an obverse surface and a reverse surface; and a fur strip including hair covering at least either one of the obverse and the reverse surfaces. The fur strip is attached to the base in a manner allowing the base to be stretchable.

The elastic base may be expandable only in one direction or in more directions.

According to a preferred embodiment, the elastic base comprises an elastic net including warps and wefts, wherein at least one of the warps and the wefts is elastic. The fur strip is wound around at least one of the warps and the wefts in a manner causing the hair to extend outward.

According to another preferred embodiment, the elastic base comprises an elastic net including warps and wefts to form meshes, wherein at least one of the warps and the wefts is elastic. The fur strip alternately passes through the meshes without winding around the warps nor the wefts.

Preferably, the fur material may further comprise a piece of elastic cloth attached to an edge of the net.

According to a preferred embodiment, the elastic base comprises a piece of elastic cloth According to a second aspect of the present invention, there is provided a product comprising: a first portion; and a second portion connected to the first portion. The first portion comprises a fur material including: an elastic base having an obverse surface and a reverse surface; and a fur strip including hair covering at least either one of the obverse and the reverse surfaces, wherein the fur strip is attached to the base in a manner allowing the base to be stretchable.

According to a third aspect of the present invention, there is provided a piece of clothing comprising: a main body made of a non-fur material and provided with a button; and an accessory attached to the main body by the button. The accessory is made of a fur material which comprises an elastic net and a fur strip attached to the elastic net in a manner allowing the net to be stretchable. The net includes a plurality of meshes one of which is engaged with the button of the main body.

According to a fourth aspect of the present invention, there is provided an accessory for clothing, wherein the clothing is provided with a button. The accessory comprises: an elastic net; and a fur strip attached to the elastic net in a manner allowing the net to be stretchable. The net includes a first row of meshes and a second row of meshes, wherein the first row is used for engagement with the fur strip, and the second row is used for engagement with the button of the clothes.

BRIEF DESCRIPTION OF THE DRAWINGS

FIG. 4 is a perspective view showing the fur material of the first embodiment;

FIG. 5 illustrates the fur material of the first embodiment used as a cuff trim;

FIG. 6 illustrates the fur material of the first embodiment used as a collar trim;

FIG. 7 illustrates the fur material of the first embodiment used as a trim for a hood;

FIG. 20 shows a principal part of a fur material according to a tenth embodiment of the present invention;

FIG. 21 shows a principal part of a fur material according to an eleventh embodiment of the present invention;

FIG. 22 shows a principal part of a fur material according to a twelfth embodiment of the present invention;

FIG. 23 shows a principal part of a fur material according to a thirteenth embodiment of the present invention;

FIG. 24 shows a principal part of a fur material according to a fourteenth embodiment of the present invention;

FIG. 25 shows a principal part of a fur material according to a fifteenth embodiment of the present invention;

FIG. 26 shows a sectional view showing a fur material according to a sixteenth embodiment of the present invention;

FIG. 27 shows a fur material according to a seventeenth embodiment of the present invention;

FIG. 28 shows a fur material according to an eighteenth embodiment of the present invention;

FIG. 29 is a sectional view taken along lines X—X in FIG. 28;

FIG. 30 shows a fur material according to a nineteenth embodiment of the present invention;

BEST MODE FOR CARRYING OUT THE INVENTION

The present invention will now be described in detail with reference to the accompanying drawings.

(1) First Embodiment (FIGS. 1–10)

FIGS. 1–10 illustrate a fur material according to a first embodiment of the present invention. As best shown in FIG.

1, the fur material 1 includes an elastic base or net 2 and a fur strip 3. The fur strip 3 may be obtained by cutting the hide of a rabbit into narrow strips each having a width of 1–5 mm for example.

Figure 1:
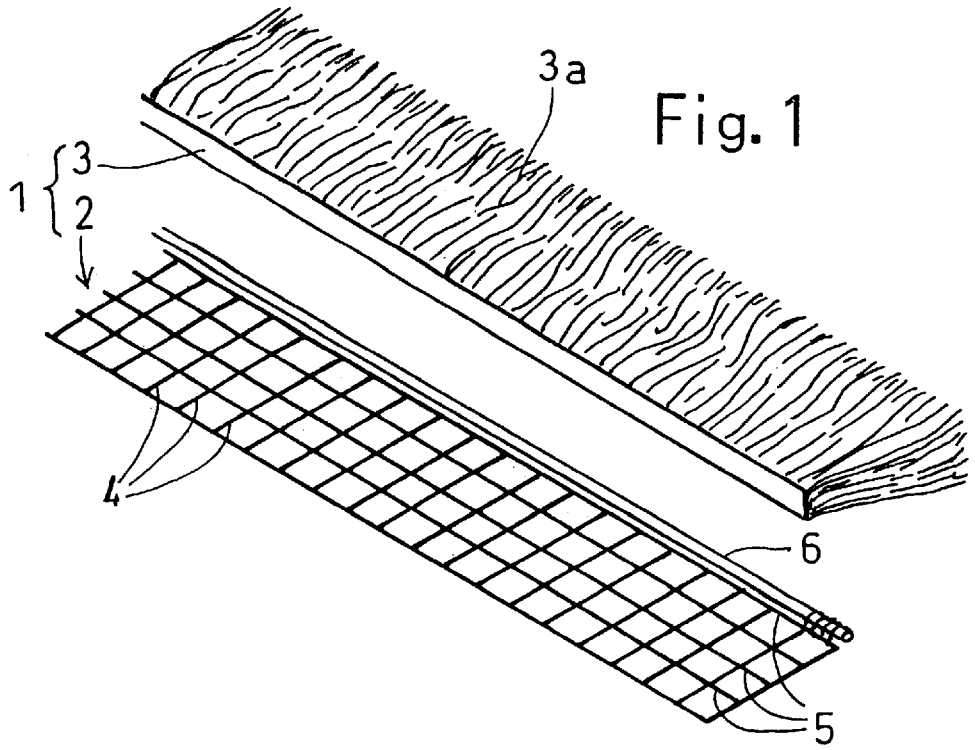
FIG. 1 is an exploded view showing a fur material according to a first embodiment of the present invention.
Figure 2:
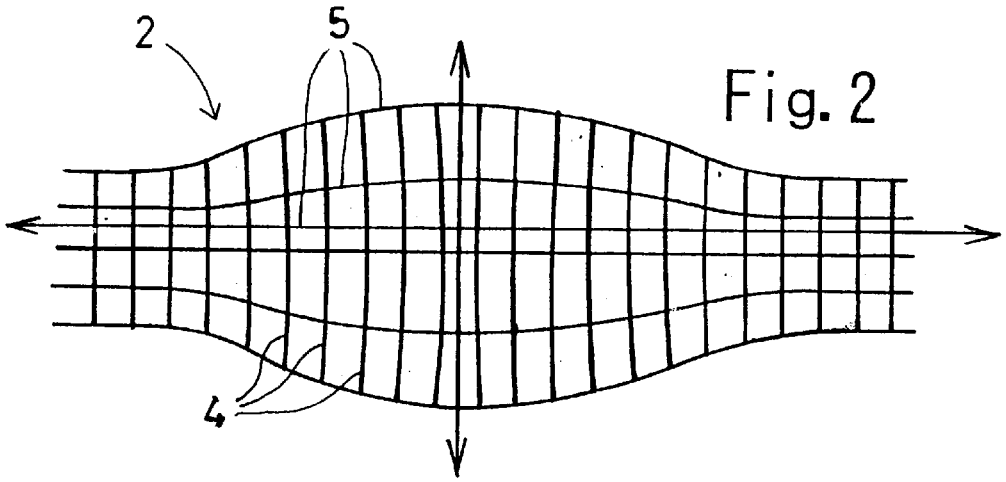
FIG. 2 is a plan view showing an elastic net used for the fur material of the first embodiment.

The elastic net 2 is made up of warps 4 and wefts 5. Each of the warps 4 and wefts 5 is an excellent elastic member which may include a rubber string (core) wound up by fine threads. As shown in FIG. 1, a thick reinforcing string 6 is attached to a marginal weft 5. The reinforcing string 6 also has an excellent elasticity. Thus, the elastic net 2 is stretchable in every direction (see FIG. 2, where only two directions are shown for simplicity of illustration).

The mesh size of the net 2 maybe 2~5 mm×2~5 mm for allowing the insertion of the fur strip 3. The warps 4 and the wefts 5 may be as thin as possible to achieve a weight reduction of the fur material 1, or to make the net 2 less conspicuous. Preferably, the color of the warps 4 and wefts 5 is the same as or similar to the color of the fur, thereby preventing the net 2 from standing out in the fur material 1.

Figure 3:
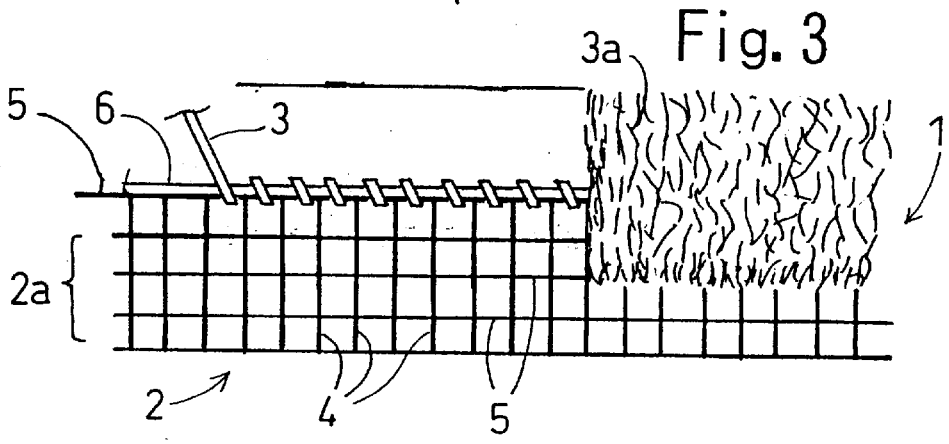
FIG. 3 is a plan view showing the fur material of the first embodiment, with some part cut away.

As shown in FIG. 3, the fur strip 3 is wound spirally around the pair of the reinforcing string 6 and the marginal weft 5, thereby stitching the first longitudinal row of the net meshes. The pitch of the spiral is equal to the pitch of the meshes in the first longitudinal row. The other longitudinal rows of net meshes (three rows in FIG. 3) remain to be unstitched by the fur strip 3. This unstitched area 2*a* of the net 2 will be referred to as "attachment area" below.

According to the present invention, the fur strip 3 may be wound around a different weft 5 than the illustrated marginal weft 5. Further, two or more wefts 5 may be wound up together by the fur strip 3. In this case, at least one longitudinal row of net meshes should be left unstitched to provide an attachment area 2*a*.

The fur strip 3 is wound up around the winding core (i.e., the marginal weft 5 and reinforcing string 6) in a manner causing the hairs of the fur to extend generally outward from the core. Thus, as shown in FIG. 4, the fur strip 3 conceals a part of the net 2 that is closer to the winding core. The upper and the lower sides of this particular part are invisibly covered by the fur.

Due to the spiral winding, the net length of the fur strip 3 is rendered much greater than the length of the net 2. This allows the net 2 to be stretched in every direction, particularly in the longitudinal direction of the net 2, though the fur strip 3 itself is not expandable in its longitudinal direction. The reinforcing string 6 helps to maintain the original shape of the fur material 1.

Figure 8:
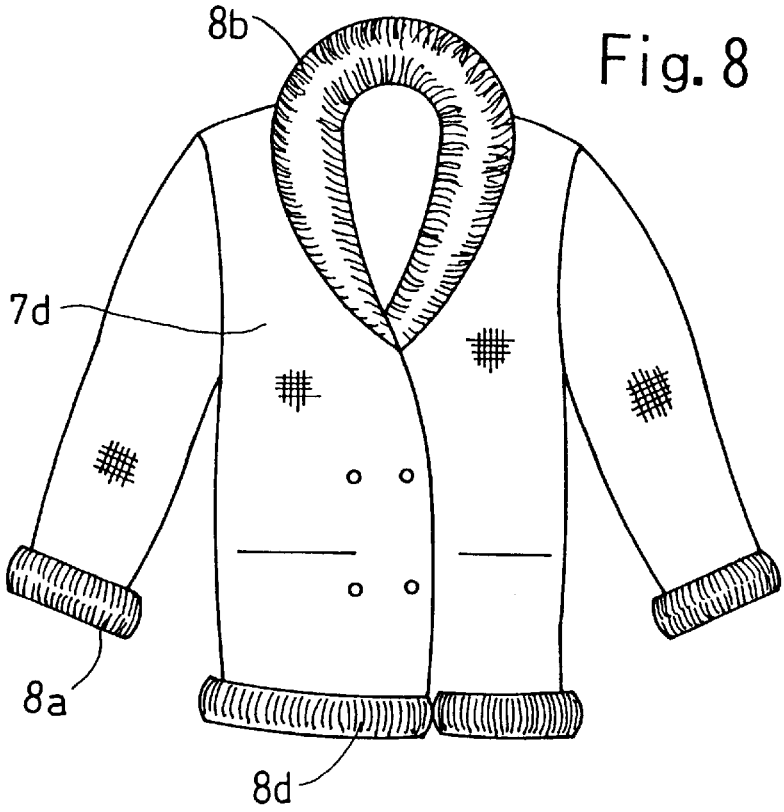
FIG. 8 illustrates the fur material of the first embodiment used as different kinds of trims for a jacket.

The above-described fur material 1 can be utilized in many ways. FIGS. 5–8 show some of the examples in which the fur material 1 is used as an accessory for clothing. Specifically, FIG. 5 shows the fur material 1 used as a trim 8*a* of the cuff of a coat 7*a*. FIG. 6 shows the fur material 1 used as a trim 8*b* attached to the collar of a cloak 7*b*. FIG. 7 shows the fur material 1 used as a trim 8*c* for a hood 7*c*. FIG. 8 shows the fur material 1 used as a trim 8*a*, 8*b* or 8*d* for a jacket 7*d*.

Figure 9:
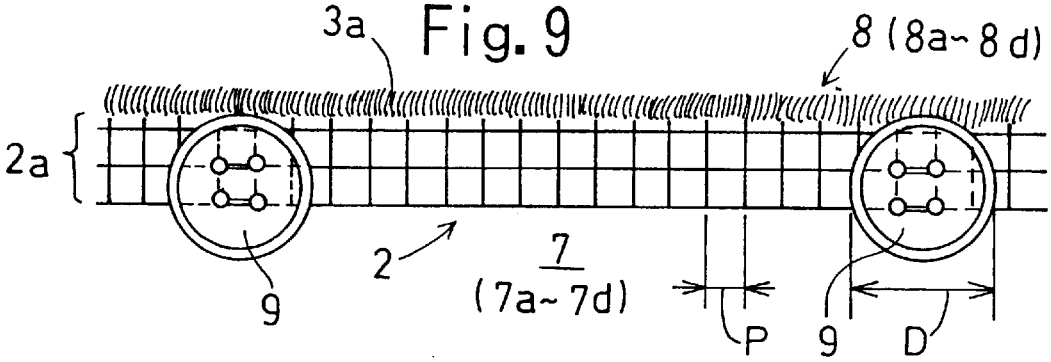
FIG. 9 illustrates how the fur material of the first embodiment is attached to a piece of clothes.

FIG. 9 shows how the trims 8*a* –8*d* (collectively denoted by reference numeral 8) are removably attached to the clothing 7*a* –7*d* (collectively denoted by reference numeral 7). As illustrated, a suitable number of buttons 9 are sewn to the clothing 7. Each button 9 is engaged with one of the meshes in the attachment area 2*a* of the net 2. The diameter D of the button 9 is great enough to prevent the engaging mesh from coming off accidentally. On the other hand, it is easy to bring the net 2 into engagement with the button 9, since the meshes of the net 2 can be readily expanded. Further, the pitch P of the meshes is very small (2–5 mm for example). Thus, even if the buttons 9 are not disposed exactly at predetermined positions on the clothing 7, it is possible to properly attach the trim 8 to the clothing 7.

In place of the buttons 9, use may be made of other kinds of fasteners including hooks, zippers, etc., for removably attaching the trim 8 to the clothing 7. Alternatively, the trim 8 may be sewn to the clothing 7 for more stable fixation.

For keeping warm, the cuff of the clothing 7 may preferably be puckered by the cuff trim 8*a* to such an extent that the wrist of the wearer is not uncomfortably constricted. With the cuff thus narrowed, the wearer still finds no trouble in passing his or her hand through the cuff due to the substantial elasticity of the trim 8*a* (i.e., fur material 1).

Figure 10:
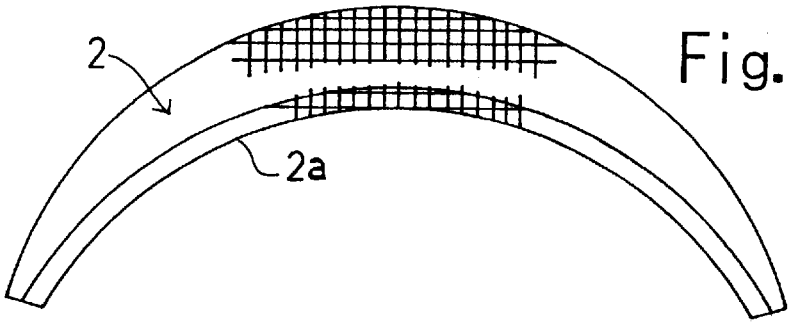
FIG. 10 is a plan view showing an elastic net used for the collar trim shown in FIG. 8.

As seen from FIG. 8, the collar trim 8*b* may preferably taper toward its both ends. Further, the collar trim 8*b* should perfectly fit the collar of the jacket 7*d*. To meet these requirements, the elastic net 2 for the collar trim 8*b* may need to have a crescent configuration, as shown in FIG. 10 (plan view).

Figure 11:
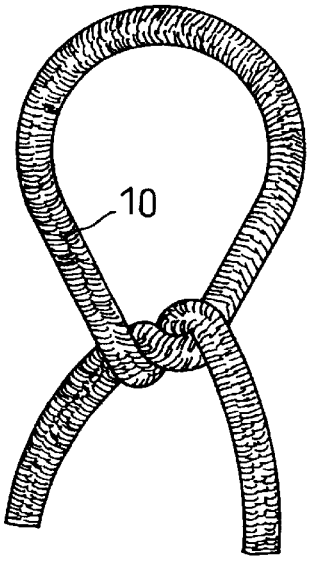
FIG. 11 shows a muffler according to a second embodiment of the present invention.

(2) Second Embodiment (FIG. 11)

According to the second embodiment, the fur material 1 is used to provide a muffler 10, as shown in FIG. 11. Though not illustrated, an elongated elastic net is used as a base to which fur strips 3 (see FIG. 1) are attached in an expandable manner.

Figure 12:
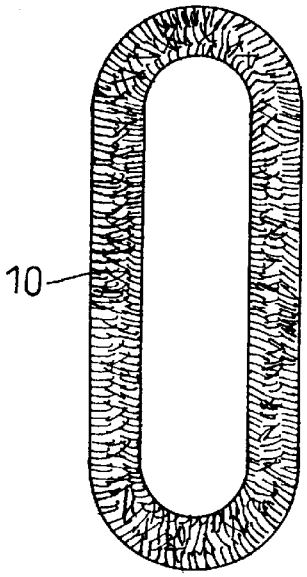
FIG. 12 shows a muffler according to a third embodiment of the present invention.

(3) Third Embodiment (FIG. 12)

According to the third embodiment, the fur material 1 is used to provide a loop muffler 10, as shown in FIG. 12. In this case again, the muffler 10 is suitably expandable, so that the wearer can easily put it on or take it off.

Figure 13:
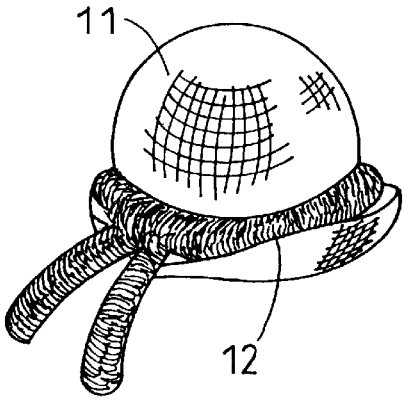
FIG. 13 shows an accessory according to a fourth embodiment of the present invention.

(4) Fourth Embodiment (FIG. 13)

According to the fourth embodiment, the fur material 1 is used to provide an ornament 12 for a hat 11. As illustrated, the ornament 12 is provided with an expandable loop portion into which the dome of the hat 11 is fitted.

In this embodiment, the fur material 1 is used as an ornament for the hat 11. However, according to the present invention, the hat 11 itself may be made of the fur material 1. In this case, the resulting hat is expandable, so that it can fit any person.

Figure 14:
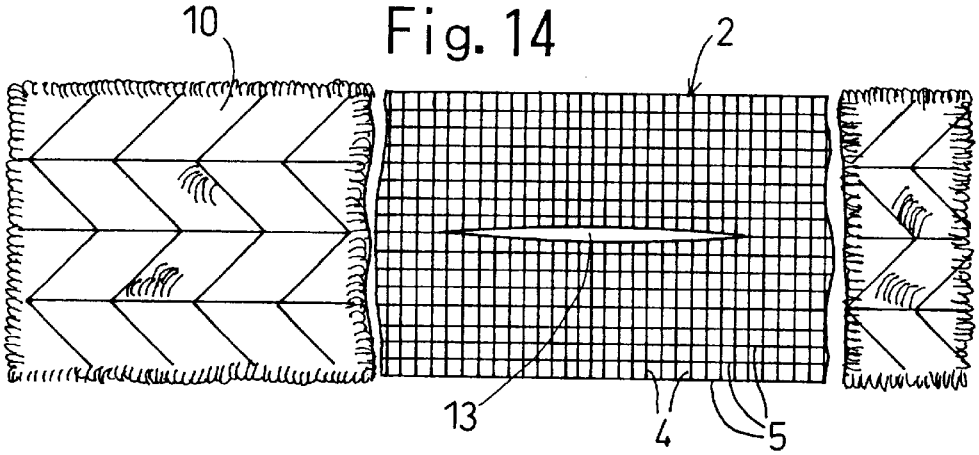
FIGS. 14 and 15 show a muffler according to a fifth embodiment of the present invention.
Figure 15:
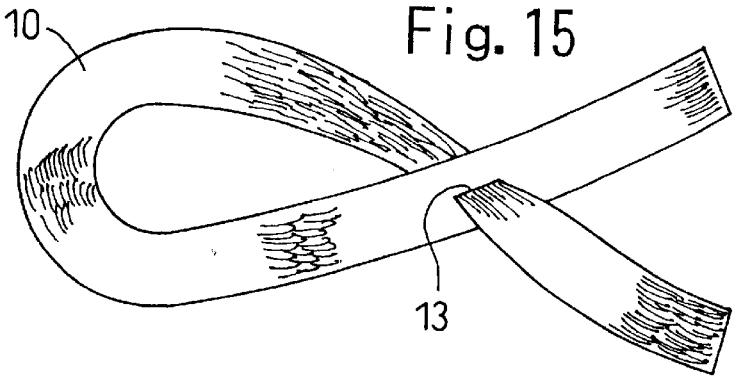

(5) Fifth Embodiment (FIGS. 14–15)

According to the fifth embodiment, the fur material 1 is used to provide a muffler 10. As best shown in FIG. 14, the elastic net 2 is provided with a slit 13 closer to one of the ends of the muffler 10. In FIG. 14, the net 2 is depicted as partially exposed for clarity of illustration, though actually it is invisibly covered by the fur. The slit 13 may preferably be elongated along an imaginary center line extending longitudinally of the muffler 10. To wear the muffler 10, the other end of the muffler 10 is inserted into the slit 13, as shown in FIG. 15, thereby providing a loop to encircle the neck of the wearer. Due to the fluffiness, the inserted end of the muffler 10 does not easily come off from the slit 13.

As shown in FIG. 14, the muffler 10 may be divided into four (or other number of) longitudinal regions different in color, pattern, etc. To achieve this, different types of fur strips 3 maybe attached to the base net 2. In the illustrated example, each striped region extends longitudinally of the muffler 10, though the present invention is not limited to this. For instance, the striped regions may extend crosswise of the muffler 10.

When the present invention is applied to a muffler, the base net 2 may suffice to be stretchable only in the longitudinal direction of the muffler.

Figure 16:
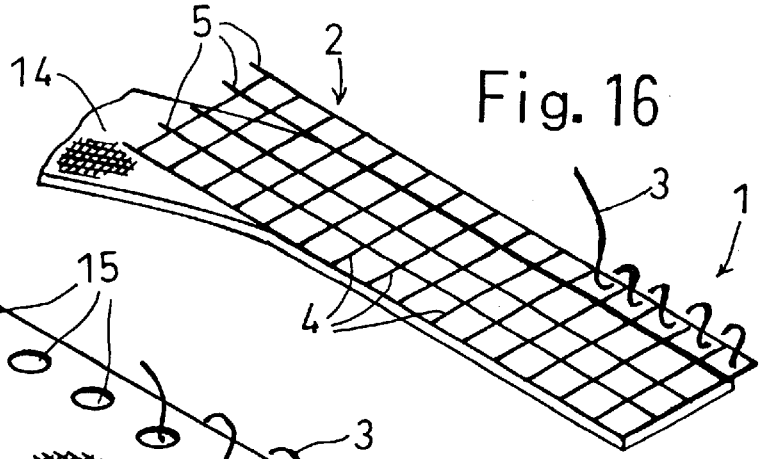
FIG. 16 shows a fur material according to a sixth embodiment of the present invention.

(6) Sixth Embodiment (FIG. 16)

According to the sixth embodiment, a fur strip 3 (the hairs omitted for clarity of illustration) is attached to a double-layer base which consists of an expandable net 2 and an expandable cloth 14. With such an arrangement, fastening pieces such as hooks or buttons can be easily fixed to the base.

Figure 17:
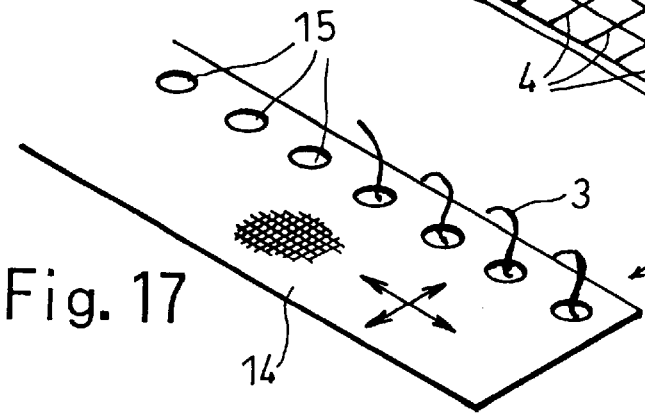
FIG. 17 shows a fur material according to a seventh embodiment of the present invention.
Figure 18:
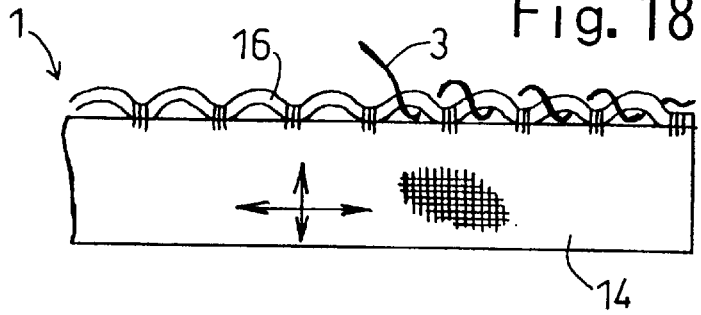
FIG. 18 shows a fur material according to an eighth embodiment of the present invention.

(7) Seventh Embodiment (FIG. 17)

According to the seventh embodiment, a fur strip 3 is attached to a single-layer expandable cloth base 14 which may be obtained by weaving or knitting expandable threads. As shown in FIG. 17, the cloth base 14 is formed with a plurality of holes 15 arranged at regular intervals along a longitudinal edge. The fur strip 3 is put through one hole after another in a spiral manner, thereby winding around the longitudinal edge of the base 14.

In the illustrated example, permanently open holes 15 are provided for winding the fur strip 3 around a longitudinal edge of the base 14. According to the present invention, in place of the holes 15, a plurality of cuts may be formed to extend through the thickness of the base 14. Since the base 14 (hence the cuts formed therein) is expandable, the fur strip 3 can be easily put through the cuts when being dilated.

According to the eighth embodiment, as in the seventh embodiment, a fur strip 3 is attached to a single-layer expandable cloth base 14. However, the cloth base 14 of this embodiment is not formed with any holes as shown in FIG. 17. Instead, an expandable string (or thread) 16 is sewn to a longitudinal edge of the base 14 at suitable intervals (e.g. 2~4 mm). The fur strip 3 is wound around the string 16.

Figure 19:
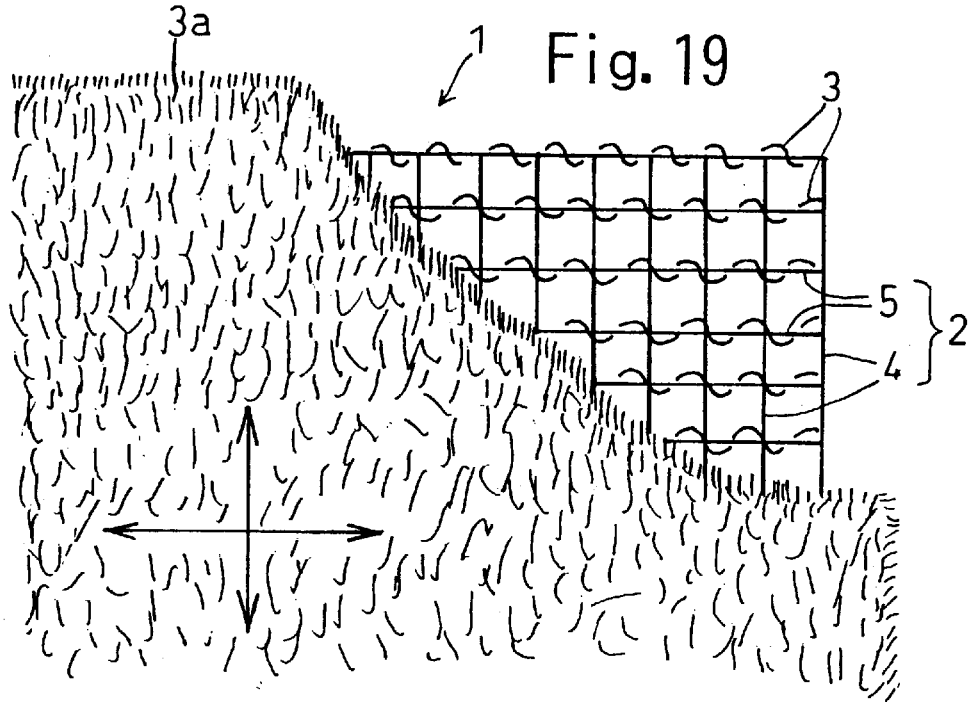
FIG. 19 shows a fur material according to a ninth embodiment of the present invention.

(9) Ninth Embodiment (FIG. 19)

According to the ninth embodiment, fur strips 3 are each wound around a relevant one of the wefts 5 of a net base 2 which is expandable in every direction. Alternatively, the fur strips 3 may be wound around the warps 4 of the base 2 only, or both the wefts 5 and the warps 4. Further, expandable lining cloth may be attached to the net base 2.

The fur material 1 of the ninth embodiment may advantageously be used to make various kinds of clothing including sweaters, vests, etc. Since the fur material 1 is highly expandable, the resulting garment fits the wearer very well. Also, the relatively large fur material 1 of the ninth embodiment is advantageously used for making a blanket, sleeping bag, or the like. To provide such a relatively large product, a number of fur materials 1 may be sewn together.

(10) Tenth-Fifteenth Embodiments (FIGS. 20–25)

FIGS. 20–25 show several examples of winding manners of the fur strip 3.

Specifically, according to the tenth embodiment, as shown in FIG. 20, fur strips 3 are wound around every two wefts 5. According to the eleventh embodiment, as shown in FIG. 21, fur strips 3 are wound around every three wefts 5.

According to the twelfth embodiment, as shown in FIG. 22, the fur strip 3 is wound around a weft 5 in a manner such that the fur strip 3 makes one turn about the weft 5 as it proceeds two meshes of the net 2. In the above-mentioned tenth or eleventh embodiment, on the other hand, the fur strip 3 makes one turn about the weft 5 as it proceeds one mesh of the net 2.

According to the thirteenth embodiment, as shown in FIG. 23, the interval L1 of the wefts 5 is made smaller than the interval L2 of the warps 4. Fur strips 3 are wound around every two wefts 5.

According to the fourteenth embodiment, as shown in FIG. 24, two or more fur strips 3 are wound together around a weft 5 of the base net 2. These fur strips 3 may be different in color, design, etc.

According to the fifteenth embodiment, as shown in FIG. 25, a fur strip 3 is wound around a weft 5 of the base net 2 in a manner such that the strip 3 makes two turns as it proceeds one mesh of the net 2.

As seen from the above embodiments, the pitch of the turns of a fur strip or mesh size of the base net may be varied in many ways. By changing these parameters, it is possible to alter the fluffiness of the resulting fur material.

(11) Sixteenth Embodiment (FIG. 26)

According to the sixteenth embodiment, an artificial fur material is provided. Specifically, FIG. 26 shows in section a fur string 17 which is made up of a thread core 18 and artificial fur 19 extending radially from the core 18. The fur 19 may be prepared separately from the core 18 and implanted to the core 18. Alternatively, the fur 19 may be obtained by napping the core 18. Preferably, the core 18 is an elastic string or thread.

In the above artificial fur string 17, the core 18 is invisibly surrounded by the fur 19, though the present invention is not limited to this. For instance, artificial fur (made of e.g. polyester) may be implanted to one side of an artificial leather strip. In this case, the other side of the strip may not be covered by the fur, thereby being exposed to the exterior.

(12) Seventeenth Embodiment (FIG. 27)

According to the seventeenth embodiment, as shown in FIG. 27, at least one fur strip 3 is wound around each of the marginal weft 5 and the marginal warp 4 for decorating purposes. In this case, the marginal fur strips 3 may preferably be different in color, pattern, etc., from the other (i.e., inner) fur strips 3.

(13) Eighteenth Embodiment (FIGS. 28–29)

According to the eighteenth embodiment, a fur material 1 is provided with an elastic net 2 and a piece of elastic cloth 20 sewn to the edges of the net 2. Such an arrangement is advantageous to facilitating the sewing of the the fur material 1 to other materials. Fur strips 3 are wound around the wefts 5 and warps 4. Most fur 3*a* of each fur strip 3 extends away from the net 2 on the upper and the lower sides of the net 2. In this embodiment, as shown in FIG. 29, some of the fur 3*a* that is disposed along the edges of the net 2 overhangs the elastic cloth 20. This is advantageous for covering the unattractive cloth portion.

(14) Nineteenth Embodiment (FIG. 30)

According to the nineteenth embodiment, as shown in FIG. 30, use is made of reinforcing strings 6 attached to an elastic base net 2 for maintaining the original shape of the fur material 1. In the illustrated example, vertical and horizontal reinforcing strings 6 are disposed at suitable intervals.

Figure 31:
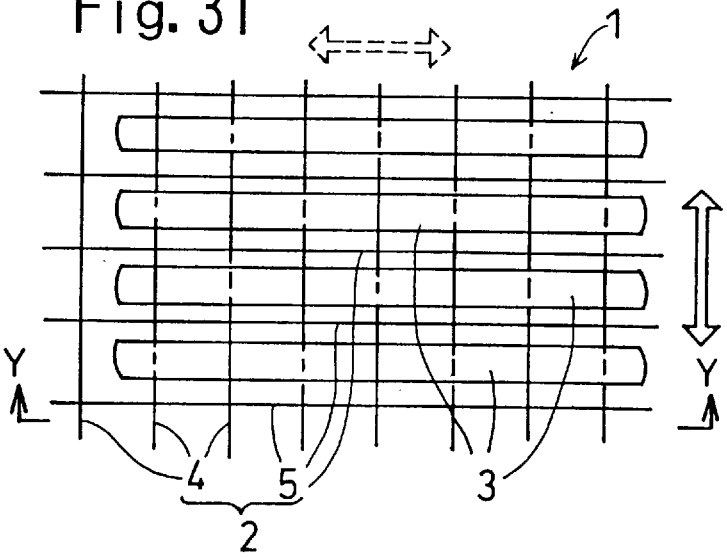
FIG. 31 shows a a fur material according to a twentieth embodiment of the present invention.
Figure 32:
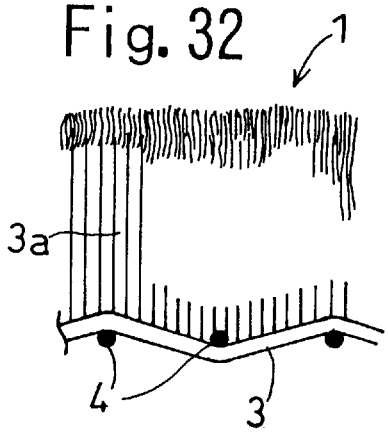
FIG. 32 is a sectional view taken along lines Y—Y in FIG. 31.

(15) Twentieth Embodiment (FIGS. 31–32)

According to the twentieth embodiment, as best shown in FIG. 32, a non-elastic fur strip 3 alternates over and under the warps 4 of a base net 2, thereby alternately passing through one mesh after another of the net. In FIG. 31, the hairs 3*a* of each fur strip 3 are omitted for clarity of illustration.

In this embodiment, the wefts 5 of the net 2 are substantially non-elastic, while the warps 4 are highly expandable. Thus, the fur material 1 is expandable only in one direction perpendicular to the longitudinal direction of each fur strip 3. Such a one-way stretchable fur material may advantageously be used for making coats or jackets since these garments do not need to be expandable in the vertical direction (in the horizontal direction, they may preferably be stretchable).

Preferably, the above warps 4 and the wefts 5 (or at least either the warps 4 or wefts 5) are as thin as possible so that these threads are unnoticed even when the fur material 1 is stretched. Advantageously, the warps 4 and the wefts 5 are rendered identical or similar in color to the hairs 3*a* of each fur strip 3.

In place of the non-elastic fur strip 3, use may be made of the elastic fur string 17 shown in FIG. 26. In this case, both the upper and the lower sides of the fur material 1 are covered by the hairs of the fur string 17. When the wefts 5 of the net 2 are elastic, the fur material 1 using the strings 17 is rendered expandable in every direction.

Figure 33:
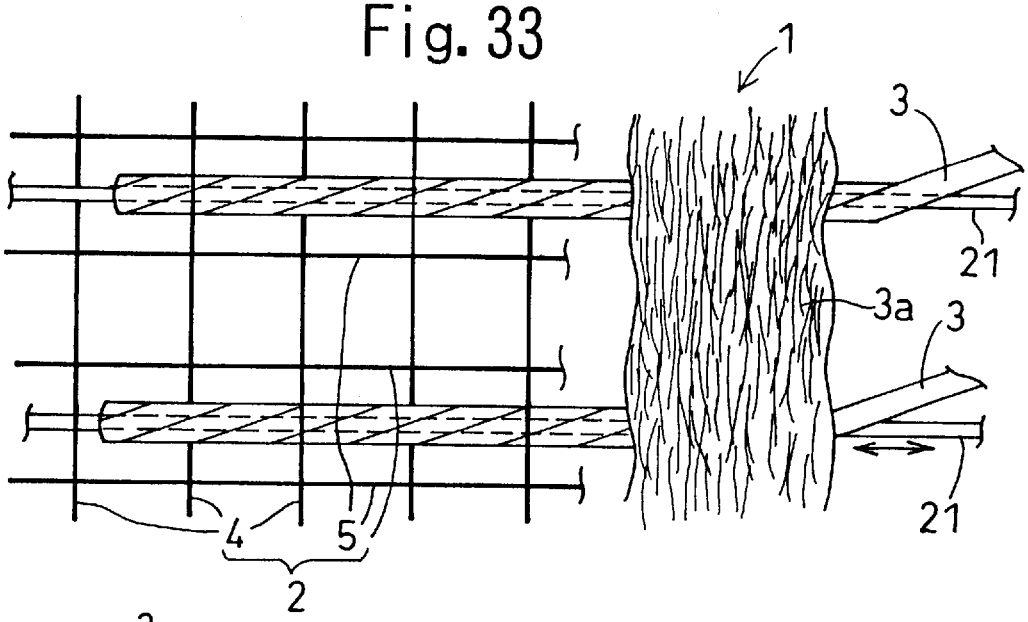
FIG. 33 shows a fur material according to a twenty-first embodiment of the present invention.

(16) Twenty-first Embodiment (FIG. 33)

According to the twenty-first embodiment, a fur strip 3 is wound around an elastic rubber string 21, as shown in FIG. 33, thereby providing an expandable fur string. This fur string, as illustrated, is caused to alternate over and under the warps 4 of a base net 2. The warps 4 and wefts 5 of the net 2 are rendered elastic. In addition, the above-mentioned fur string (3, 21) is stretchable. Thus, the resulting fur material 1 is expandable in every direction.

In the illustrated example, the fur strip 3 is wound around the core of rubber string 21. Alternatively, however, the fur strip 3 and the rubber string 21 may be twisted into an elastic cord.

Figure 34:
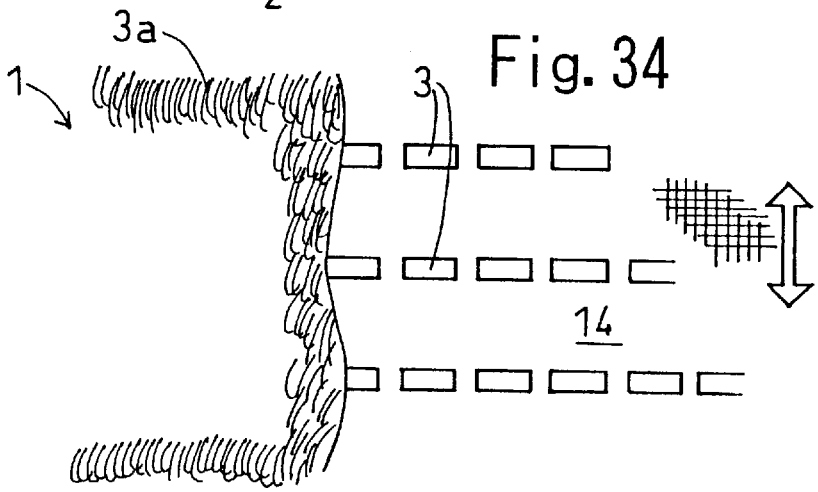
FIG. 34 shows a fur material according to a twenty-second embodiment of the present invention.

(17) Twenty-second Embodiment (FIG. 34)

According to the twenty-second embodiment, as shown in FIG. 34, elastic cloth 14 is used as an expandable base to which a plurality of fur strips 3 are attached. The cloth 14 is formed with many slits for passing the fur strips 3 to allow each fur strip 3 to alternate over and under the cloth 14. FIG. 34 shows the obverse surface of the cloth 14. According to this embodiment, each fur strip 3 is exposed more on the obverse side of the cloth 14 than on the reverse side of the cloth, so that the obverse surface of the cloth 14 is invisibly covered by the hairs 3*a* of the fur strips 3.

Figure 35:
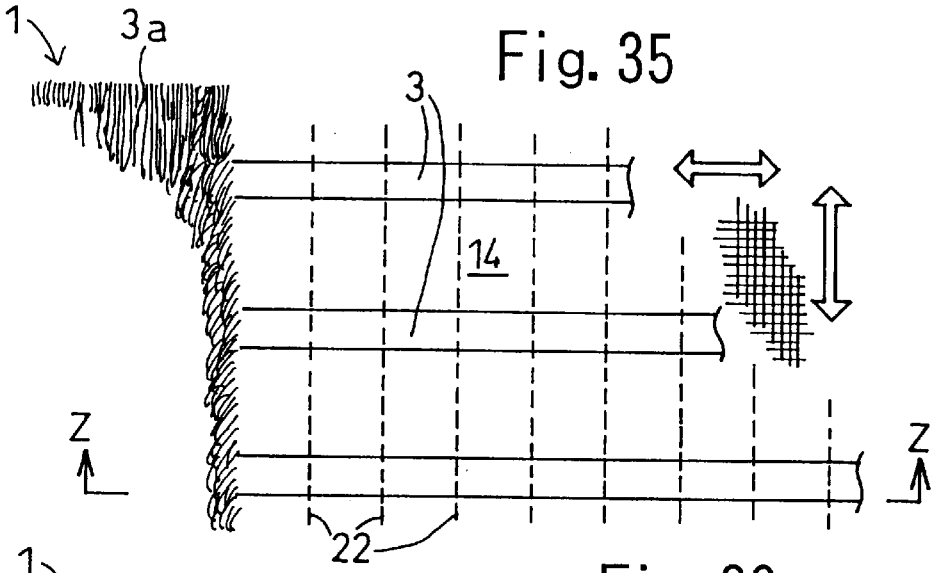
FIG. 35 shows a fur material according to a twenty-third embodiment of the present invention.
Figure 36:
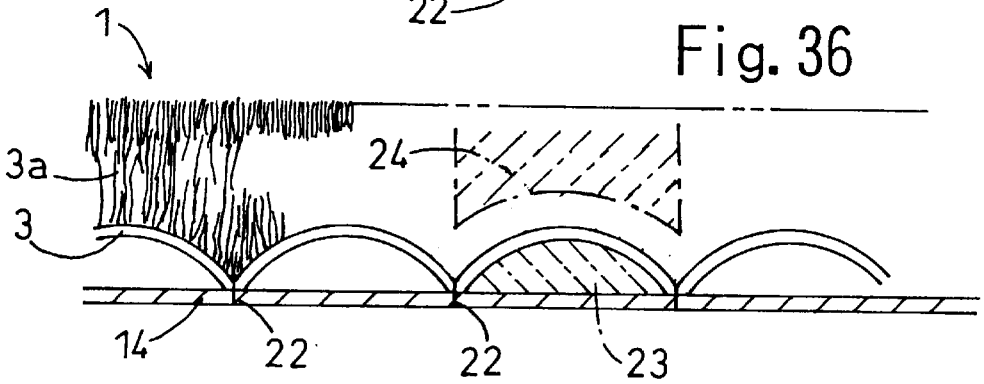
FIG. 36 is a sectional view taken along lines Z—Z in FIG. 35.

(18) Twenty-third Embodiment (FIGS. 35–36)

According to the twenty-third embodiment, as in the twenty-second embodiment described above, use is made of elastic cloth 14 which is expandable in every direction. Non-elastic fur strips 3 are stitched to the cloth 14 by elastic thread 22. As illustrated, each fur strip 3 is sewn to the cloth 14 at suitable intervals. As best shown in FIG. 36, each fur strip 3 arches between neighboring stitch portions, thereby providing room for the fur material 1 to be expanded in the longitudinal direction of the fur strips 3. For providing such an arching configuration, use may be made of an inner support member 23 and an outer pressing member 24 cooperative with the inner member 23. Specifically, while the inner member 23 is being held between the base cloth 14 and the fur strip 3, the outer member 24 is lowered to press the fur strip 3 onto the inner member 23. Then, the fur strip 3 is stitched to the cloth 14, to provide a desired arching configuration.

Figure 37:
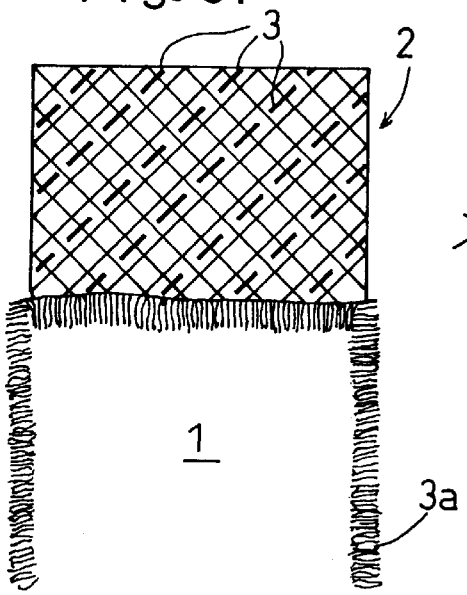
FIG. 37 shows a fur material according to a twenty-fourth embodiment of the present invention.

(19) Twenty-fourth Embodiment (FIG. 37)

According to the twenty-fourth embodiment, fur strips 3 are diagonally attached to an elastic base net 2. Each strip 3 may be woven with or wound around the threads of the net 2 for example.

Figure 38:
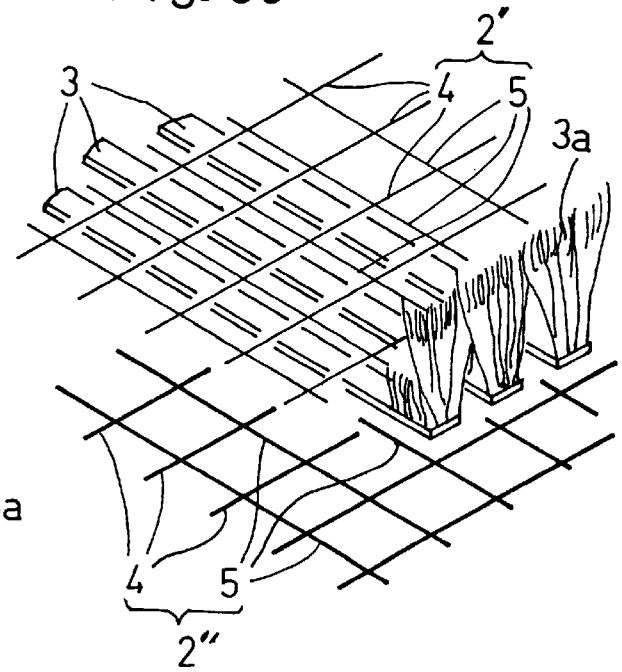
FIG. 38 shows a fur material according to a twenty-fifth embodiment of the present invention.

(20) Twenty-fifth Embodiment (FIG. 38)

According to the twenty-fifth embodiment, first and second elastic base nets 2', 2" are used for sandwiching a plurality of fur strips 3. As illustrated, the hairs 3*a* of the respective strips 3 extend generally in the same direction. The first and the second nets 2', 2" are secured to each other by binding with thread or by a suitable adhesion technique.

Both the nets 2', 2" are expandable at least crosswise of the fur strips 3. Preferably, the threads 4, 5 of the first base net 2' are as thin as possible. The second base net 2" may be replaced by elastic cloth.

(21) Other Possibilities

According to the present invention, the base nets or cloth may be replaced by other materials as long as the above-described fur strings are reliably attached to them. Regarding the base nets, the weaving pattern is not limited to the rectangular mesh pattern disclosed in the drawings. For example, the base net may be produced in a cobweb pattern. Further, the elastic base may have a three-dimensional structure like a cylinder.

It is possible to fix a fur strip to an elastic base over the entire length of the strip or in selected places of the strip. The fixation may be achieved by adhesion, binding, or ultrasonic bonding for example.

When the present invention is applied to clothing or personal items, a plurality of fur material pieces may be sewn together to provide a final product. Alternatively, a three-dimensional basic structure (corresponding to the final product) may first be prepared by using elastic base nets, and then fur strips maybe woven into the basic structure. This alternative technique is suitable for making products of a relatively simple structure such as vests or leg warmers.

What is claimed is:

1. A fur material comprising:

an elastic base having an obverse surface and a reverse surface; and a fur strip including hair covering at least either one of the obverse and the reverse surfaces, the fur strip being attached to the base in a manner allowing the base to be stretchable, wherein the elastic base comprises an elastic net including warps and wefts, at least one of the warps and the wefts being so elastic that deformation thereof is noticeable by a user of the fur material, the fur strip being wound helically around said at least one of the warps and the wefts in a manner causing the hair to expand outward.

2. The fur material according to claim 1, wherein the elastic net includes a row of meshes arranged along said at least one of the warps and the wefts around which the fur strip is helically wound, the fur strip making at least two turns for each of the meshes.

3. The fur material according to claim 1, wherein said at least one of the warps and the wefts comprises a rubber string.

4. The fur material according to claim 1, wherein the elastic net is more expandable than the fur strip.

5. A fur material comprising:

a base having an obverse surface and a reverse surface; and a fur strip having hair, the fur strip attached to the base without hampering elasticity of the base, wherein the base comprises a net that is provided with a plurality of meshes and is rendered so elastic at least in a prescribed direction that deformation thereof is noticeable by a user of the fur material, the fur strip being attached to the net in a manner such that the fur strip alternately passes through the meshes of the net without winding around strings of the net, the hair of the fur strip being exposed outside of the net, and wherein the fur strip extends longitudinally in a direction substantially perpendicular to said prescribed direction.

6. The fur material according to claim 5, wherein the net includes warps and wefts, at least one oft he warps and the wefts being elastic.

7. The fur material according to 5, further comprising a piece of elastic cloth attached to an edge of the net.

8. A fur material comprising:

a piece of cloth that has an obverse surface and a reverse surface and is rendered so elastic in a prescribed direction that deformation thereof is noticeable by a user of the fur material; and a fur strip including hair covering at least either one of the obverse surface and the reverse surface, the fur strip being attached to the piece of cloth in a manner allowing the piece of cloth to be stretchable, wherein the fur strip extends longitudinally in a direction substantially perpendicular to said prescribed direction.

9. A product comprising:

a first portion; and a second portion connected to the first portion, wherein the first portion comprises a fur material including: a net having an obverse surface and a reverse surface, the net being so elastic that deformation thereof is noticeable by a user of said product; and a fur strip including hair covering at least either one of the obverse and the reverse surfaces, the fur strip being attached to the net in a manner allowing the net to be stretchable, wherein the fur strip is attached to the net in either one of a manner such that the fur strip winds helically around a string of the net and a manner such that the fur strip alternately passes through meshes of the net.

10. A piece of clothing comprising:

a main body made of a non-fur material and provided with a button; and an accessory attached to the main body by the button, wherein the accessory is made of a fur material which comprises a net and a fur strip, the net being so elastic that deformation thereof is noticeable by a user of the accessory, the fur strip being attached to the net in a manner allowing the net to be stretchable, the net including a plurality of meshes one of which is engaged with the button of the main body.

11. An accessory for clothing, the clothing being provided with a button, the accessory comprising:

a net which is so elastic that deformation thereof is noticeable by a user of the accessory; and a fur strip attached to the net in a manner allowing the net to be stretchable, wherein the net includes a first row of meshes and a second row of meshes, the first row being used for engagement with the fur strip, the second row being used for engagement with the button of the clothing.

12. A fur material comprising:

a piece of cloth having an obverse surface and a reverse surface, the piece of cloth being so elastic that deformation thereof is noticeable by a user of the fur material; and a fur strip including hair covering at least one of the obverse and the reverse surfaces, wherein the fur strip is sewn to the piece of cloth to provide a plurality of arches for allowing the piece of cloth to be stretchable.

* * * * *